United States Patent [19]

Galli et al.

[11] Patent Number: 4,600,545

[45] Date of Patent: Jul. 15, 1986

[54] PROCESS FOR THE PREPARATION OF FIBERS FROM POLYMERIC MATERIALS

[75] Inventors: Paolo Galli; Paolo Parrini, both of Ferrara, Italy

[73] Assignee: Montecatini Edison S.p.A., Milan, Italy

[21] Appl. No.: 22,057

[22] Filed: Mar. 19, 1979

Related U.S. Application Data

[63] Continuation of Ser. No. 847,429, Nov. 1, 1977, abandoned, which is a continuation of Ser. No. 606,453, Aug. 21, 1975, abandoned, which is a continuation of Ser. No. 335,335, Feb. 23, 1973, abandoned.

[30] Foreign Application Priority Data

| | | | |
|---|---|---|---|
| Feb. 25, 1972 | [IT] | Italy | 21055 A/72 |
| Jan. 30, 1973 | [IT] | Italy | 19786 A/73 |
| Feb. 1, 1973 | [IT] | Italy | 19921 A/73 |

[51] Int. Cl.[4] ..... D21B 1/36

[52] U.S. Cl. ..... 264/11; 264/12; 264/13; 264/14; 264/85; 264/211; 162/21; 162/22

[58] Field of Search ..... 264/12, 13, 11, 14, 264/85, 211; 162/21, 22

[56] References Cited

U.S. PATENT DOCUMENTS

| | | | |
|---|---|---|---|
| 2,988,469 | 6/1961 | Watson | 264/DIG. 75 |
| 3,885,014 | 5/1975 | Fukada | 264/205 |
| 4,189,455 | 2/1980 | Raganato et al. | 264/12 |

FOREIGN PATENT DOCUMENTS

| | | | |
|---|---|---|---|
| 44-7728 | 4/1969 | Japan | 264/13 |

*Primary Examiner*—Donald Czaja
*Assistant Examiner*—Hubert C. Lorin

[57] ABSTRACT

Polyolefin fibers, which are suited for at least partially substituting the cellulose fibers in the manufacture of paper, are produced by a process which consists in preparing in a pressure vessel a solution of a polyolefin at a temperature higher than the boiling temperature of the solvent under normal conditions, and under autogenous pressure or a pressure greater than the autogenous pressure, in ejecting said solution under the above stated conditions into a zone of lower pressure, in allowing the ejected solution to expand at least partially in said zone, and in then hitting the at least partially expanded solution with a jet of a high-speed fluid, which is at a temperature lower than that of the solution, and has an angled direction with respect to the direction of ejection of the solution.

23 Claims, 4 Drawing Figures

PROCESS FOR THE PREPARATION OF FIBERS FROM POLYMERIC MATERIALS

This is a continuation of application Ser. No. 847,429, filed Nov. 1, 1977, now abandoned; which in turn is a continuation of Ser. No. 606,453 filed Aug. 21, 1975, now abandoned; which in turn is a continuation of Ser. No. 335,335, filed Feb. 23, 1973, now abandoned.

BACKGROUND OF THE INVENTION

1. Field of the Invention

The present invention pertains to the field of fibers of synthetic polymer materials, which are suited for replacing the cellulose fibers in the manufacture of paper.

2. Description of the Prior Art

The production of fibers of synthetic polymer materials, having such characteristics as to be suited, without previous cutting or disgregating operations, for replacing at least partially the cellulose fibers in the manufacture of paper, is known.

However, the various methods which have been employed in the past for said production, proved to be so expensive as to make of the preparation of paper from such fibers an unprofitable proposition.

Thus, in U.S. Pat. Nos. 2,999,788 and 2,988,782 there are described processes for the preparation of fibrous particles of a very thin thickness and 10 to 100$\mu$ in length, commonly called fibrils or fibrids, which processes consist in gradually adding a synthetic polymer solution to precipitating agents for the polymer, under simultaneous heavy stirring. This process is however limited to the use of condensation polymers; moreover the microfibers thus prepared, due to their high cost, do not find a practical use, in spite of their interesting characteristics.

Quite recently there was suggested the preparation of fibrils of olefin polymers directly during the polymerization of the monomers (reactor fibers), this latter being carried out in the presence of suitable solvents and by keeping up a stirring exerting high shearing forces.

A process of this type is disclosed in British Pat. No. 1,287,917. The fibrils obtained through it, with a length varying from a few tenths of a micron to some millimeters, are particularly suited for being incorporated in the paper pulps in various percentages, and their characteristics allow their treatment by means of the standard paper processing machinary. The process herein above described has, however, the drawback of requiring special reactors expressly designed for this process (since the standard reactors for the polymerization of olefins are unsuited for the purpose) and only useable for this particular production.

SUMMARY OF THE INVENTION

I have discovered that polyolefin fibers, directly suited for replacing at least partially the cellulose fibers in the manufacture of paper, may be very economically obtained by a process which consists in preparing a solution of a polyolefin, at a temperature higher than the boiling temperature of the solvent under normal conditions, and under the autogeneous pressure or a pressure greater than the autogeneous one, in ejecting said solution, under the above stated conditions, through a nozzle, into a zone of lower pressure, in allowing the ejected solution to expand at least partially in such zone, and in then hitting the at least partially expanded solution with a jet of a high-speed fluid which is at a temperature lower than that of the solution and has an angled direction with respect to the direction of ejection of the solution.

DESCRIPTION OF THE PREFERRED EMBODIMENTS

Crystalline polyolefins, obtained by homo- or copolymerization of monomers having general formula:

$$CH_2{=}\underset{\underset{R}{|}}{CH} \quad (R = H, \text{alkyl or phenyl})$$

such as polyethylene, polypropylene, polybutene-1, poly-4-methylpentene-1, polystyrene, copolymers ethylene-propylene, and the like, may be used in the process of the present invention.

Particularly interesting polymeric materials proved to be the linear polyethylene of the type that is obtained by means of supported Ziegler catalysts, such as those described for instance in Italian Pat. Nos. 853,733, 853,734 and 860,130, the polypropylene essentially consisting of isotactic macromolecules, of the type that is obtained by means of Ziegler-Natta catalysts such as those described, for instance, in Italian Pat. No. 526,101, and mixture of said polyolefins with minor amounts of other polymers such as polyvinyl chloride, polyvinyl acetate, polymethylmethacrylate, polyamides, polyoxymethylene, cellulose acetate, etc.

For preparing fibers endowed with a high cohesive power, there may be used polyolefins of the above indicated general formula, modified by introducing into them polar groups.

It may be advisable though not indispensable that the solvent used in the solution shall have a boiling temperature lower than the melting temperature of the polymer. In general there may be used all those solvents, liquid or gaseous under normal conditions, that are suited for supplying homogeneous solutions of the polymer under operational conditions.

Solvents suitable for use may be, for instance: aliphatic hydrocarbons such as n- or iso-butane, pentane, hexane, heptane, octane; cycloaliphatic hydrocarbons such as cyclohexane; aromatic hydrocarbons, such as benzene, toluene, xylene, chlorinated hydrocarbons such as chlorobenzene, trichloroethylene, tetrachloroethylene, trichlorofluoromethane.

The process may be used by employing a wide range of concentrations of the polymeric solutions, also depending on the molecular weight and on the type of polymer used. In general there may be used solutions containing from 1 to 700 g/lt of polymer; for attaining best results it is advisable to use solutions containing from 50 to 400 g/lt of polymer.

In general it was found that the best operational conditions, with regard to the obtention of fibers of homogeneous dimensions and usable in paper pulps without any particular processing, are those offered by the use of polymeric solutions having, under operational conditions, absolute viscosities like those found at 130° C. in a solution obtained by dissolving in 1 lt of hexane 100 g of polyethylene having a $[\eta]$ in tetralin at 135° C.=0.9.

Pigments, fillers, stabilizing agents, antistatic agents and/or other substances suited for modifying the surface properties of the fibers, may be added to the polyolefin solutions. Particularly convenient proved to be the addition to the solution of surfactants, the fact which allows one to obtain fibers readily dispersible in water. The dispersibility in water of the fibers is a very important factor for their utilization in the preparation of paper according to conventional methods. The lack of hydrophile properties of the polyolefin fibers makes such a dispersion rather difficult in the preparatory stage of the aqueous stuff. On the other hand, the addition of the water of surfactant compounds before or during the dispersion operation of the fibers, involves certain drawbacks, such as for instance the formation of foam that causes the stratification of the synthetic material, when one operates, for instance, with mixes of polyolefinic fibers with cellulose fibers. The addition of a wetting agent directly to the polyolefinic solution before its extrusion, allows one to overcome such difficulties.

The wetting or surfactant agent used, must be uniformly soluble or mixable in the solvent and in the polyolefin. It may indifferently be of the anionic, cationic, non-ionic, or amphoteric type. Amongst the surfactants of the anionic type, usable for the purpose, there may be cited, for instance, the soaps of fatty acids, the soaps of naphthenic acids, the salts of sulphuric acid esters, the alkaline sulphonates, the alkyl esters of phosphorous or phosphoric acids, the salts of alkyl-phosphoric esters, the sodium salts of the sulphuric esters of alkylphenol-polyethyleneglycole.

As surfactants of the cationic type may be used, for instance, the quaternary ammonium alkyl compounds, the aliphatic amines, the basic salts of alkylpyridinium or of alkylpicolinium, as well as the alkylbenzimidazol derivatives. Examples of usable amphoteric surfactants are: the compounds of the betaine and of the sulphobetaine type, as well as the amphoteric compounds of the group of sulphuric and phosphoric acid esters. Finally, as surfactants of the non-ionic type may be cited: the polyoxyethylene-alkyl esters and ethers, the polyoxyethylenalkyl-aryl esters, the esters of fatty acids with higher alcohols, the polyoxyethylen-alkyl-amines, the alkanol-amides of fatty acids, the block copolymers polyoxyethylene-polyoxypropylene and the polyoxyethylene-alkylthioethers.

It is necessary that the surfactant used shall remain incorporated in the fiber or at least adhering to the surface of the latter as much as possible. For this purpose the surfactant should be selected from amongst those surfactants which have a boiling temperature higher than that of the solution at the moment of its ejection from the pressure vessel. By means of a suitable choice of the surfactant, it is thus possible to greatly improve the property of the fibers to form a suspension in the aqueous medium. At the same time it will be found that both the antistatic properties of the fibers as well as the surface characteristics of the sheets prepared from them, will be improved.

The quantity of surfactant to be added to the polyolefin solution, for the purposes of this invention, must be greater than 0.05% by weight on the olefin polymer. However, in order to attain the best possible results, it is generally preferable to use the surfactant in a quantity exceeding 0.1% by weight on the polyolefin.

For reasons of saving, the maximum quantity of surfactant that may be added to the polymeric solution in order to obtain best results, may be kept within the limit of 5% by weight on the polymer, since greater quantities of surfactant will not yield appreciable advantages as far as the dispersion of the fibers in water is concerned.

The surfactant used according to this invention may be dissolved or dispersed in the organic solvent before, after or contemporaneously to the dissolving of the polyolefine in that solvent.

The speed at which the solution of polyolefine material is ejected through the nozzle may vary from 1,000 to 200,000 m/hr, but preferably there are used speeds comprised between 1,500 and 50,000 m/hr. The solution to be ejected should have a temperature at least 40° C., but by far more preferably 60° C. higher than the boiling temperature of the solvent under normal conditions. In order to obtain fibers of the suited morphology, it is necessary that the high-speed fluid hits the polyolefin solution after this latter has at least partially expanded in the lower pressure ambient wherein it is ejected. This is generally attained by positioning the high-speed fluid nozzle in such a way that the fluid hits the solution when this latter is at a certain distance from its exit nozzle. Such distance depends mainly on the ejection speed of the solution, but under the preferred operational conditions of the process it may be estimated to range from 1.5 mm to 15 mm.

As hitting fluid there may be used any liquid, gaseous or vaporized substance which be inert and under operational conditions has no dissolving effect on the polyolefine used, but that preferably be not mixable with the solvent of the polymeric solution. Water steam proved to be particularly suited for the purpose in as much as, in comparison with other usable fluids, it offers the further advantage of humidifying the fibers, thereby facilitating their gathering while eliminating the conflagration danger due to static electricity with which the fibers tend to charge themselves. However, use may be made of any optional fluid such as nitrogen, oxygen, carbon oxide, air, combustion gas, finely divided water, and mixtures thereof.

The speed of the hitting fluid turned out to be very important in respect to the viscosity of the solution used or with regard to the speed with which this solution is ejected through the nozzle. It has been found that the best operational conditions are obtained when operating at an impact speed of the fluid comprised between 200 and 600 m/sec. It has been found that within the range of operational conditions described above, some fluids show optimal conditions of use thanks to which fibers are obtained that possess contemporaneously the length and length/diameter ratio most suited for a convenient substitution of the cellulose fibers in the preparation of paper.

Said operational conditions refer to the values of the angle formed by the direction of the fluid jet with the direction of the solution; said values are comprised f.i. between 50° and 55° for nitrogen, between 80° and 85° for carbon dioxide and for steam, and between 40° and 60° for oxygen. According to one preferred form of embodiment of this invention, the mass of the hitting fluid is directed against the solution in the form of a mass which is geometrically co-axial with the nozzle ejecting the solution itself. When using such preferred procedures, very uniformly shaped fibers are obtained, the fact which is, amongst others, particularly useful for obtaining paper of good surface characteristics.

A clear idea of the process and of the nature of the fibers thereby obtained can be gained by referring to the attached drawings. Thus, FIG. 1 represents an indicative diagram of the plant through which it is possible to carry out in a continuous way the process according to this invention.

Figure 1:
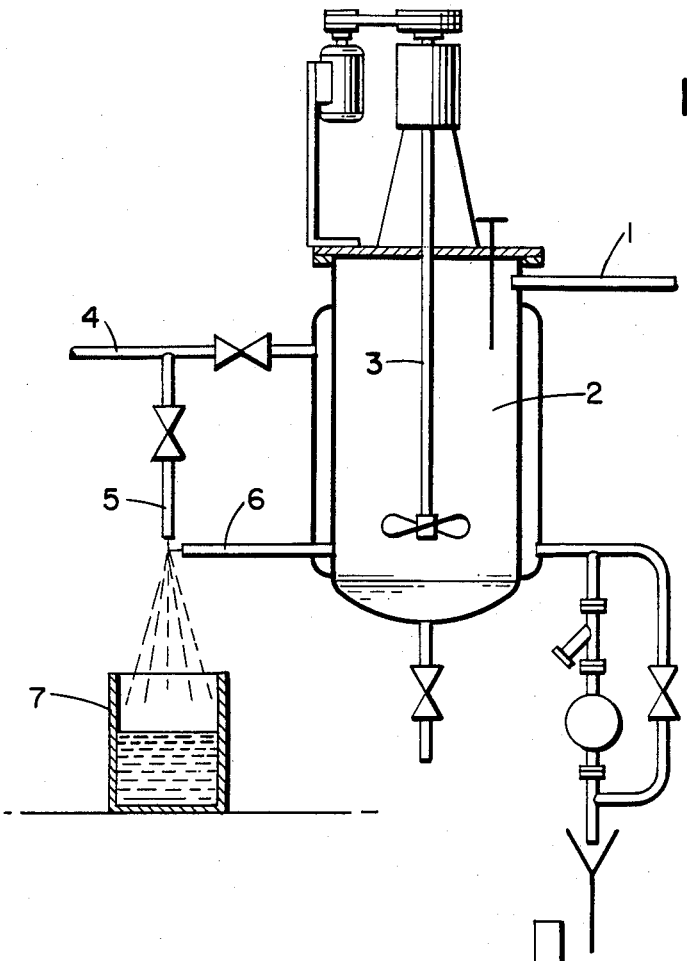
Figure 2:
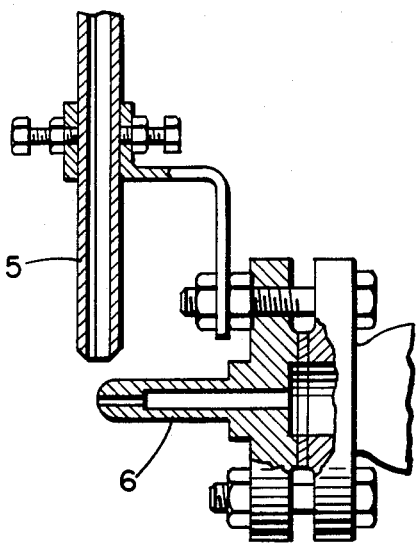
FIG. 2 illustrates in detail a system of nozzles (5) and (6) arranged at right angle, used respectively for the hitting fluid and for the polymeric solution in the device of the FIG. 1.

By reference to FIG. 1, the polymer suspension in the organic solvent is fed into the autoclave (2) fitted with a stirrer (3), through a pipe (1). The hitting fluid, fed through (4), is ejected by the nozzle (5) and hits the polymeric solution which is ejected from the autoclave through the nozzle (6). Nozzle (5) may be positioned differently with respect to nozzle (6) so that the fluid may hit the solution under different angles, and at different distances from nozzle (6). The fibers that are thus formed are then gathered in a collecting vessel (7).

Figure 3:
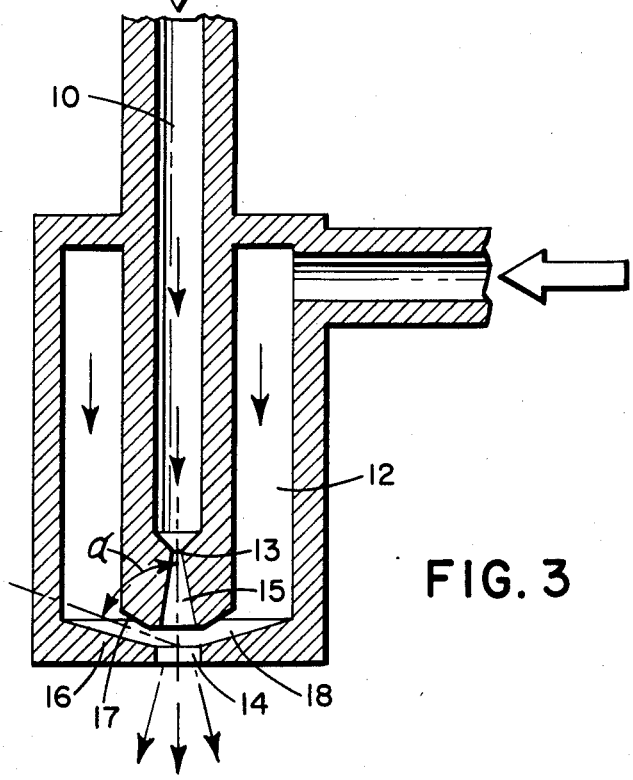
FIG. 3 represents the vertical section of a device with nozzles, that can be used for carrying out the process according to one preferred procedure, which consists in using the hitting fluid in the form of a mass which is geometrically co-axial with the ejection nozzle of the polyolefinic solution.
Figure 4:
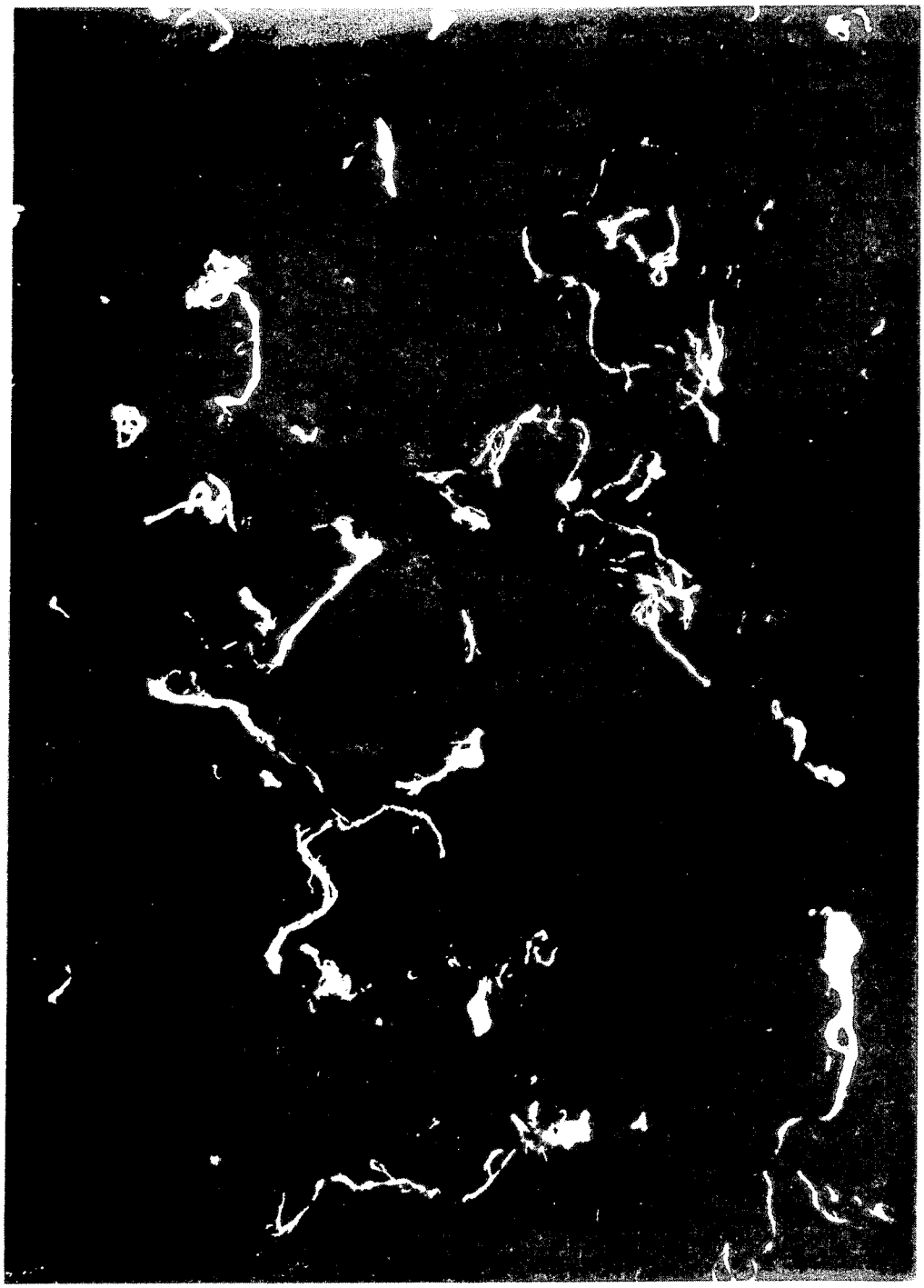
FIG. 4 represents an enlargement (54×) of a number of fiber types obtained according to the process of the present invention.

Referring to the device as illustraed in FIG. 3 there are shown two co-axial ducts (1) and (2), the first inside the other, intended respectively for the feeding of the polymeric solution and of the hitting fluid, said ducts terminating with nozzles (3) and (4).

A trunco-conical shaped chamber (5) forms a zone of lower pressure with respect to the pressure conditions existing in nozzle (3) during operation, and in which there takes place the expansion of the solution.

The terminal zones (6) and (7) of the walls of the two ducts are so configurated that the axis of the interspace (8), determined by said walls, will form with the axis of the nozzle (3), in the ejection direction, an angle $\alpha$ preferably comprised between about 30° and 90°.

Operating with such a device, the solution will be thus surrounded and hit angularly in every point of it by the fluid ejected by nozzle (4).

It is quite evident that by operating a suitable resizing of zones (6) and (7), and possibly of nozzle (4), the operational conditions object of this invention can be realized also by feeding duct (1) with the high-speed fluid, and duct (2) with the polymeric solution.

In this case the fluid remains surrounded by the solution and hits this latter at an angle from the inside.

Thus, amongst the possible devices suited for establishing one of the preferred conditions of the process, that with the co-axial nozzle proved to be particularly convenient, both for the considerable constructional compactness as well as for the fact that it is suited for realizing in two ways said conditions.

The following examples are given for illustrating and not limiting the present invention.

EXAMPLE NO. 1

Into an Inox steel autoclave of 50 lt capacity, fitted with a jacket and a blade stirrer with a maximum revolving speed of 300 rev. p. min. (rpm), were loaded 30 liters of technical hexane and 2 kg of polyethylene obtained by means of supported Ziegler-type catalysts, and modified with propylene, said polyethylene having the following characteristics: melt index=0.021; [$\eta$] in tetralin at 135° C.=3.0; density==0.950; number of methyls per 100 carbon atoms=0.83; melting temperature (through DSC)=132° C.

The autoclave was then heated up by circulating steam in the jacket, until obtaining a solution under the following conditions: pressure=2.2 kg/sq.cm; temperature of solution=108° C.

The solution was then ejected from the autoclave in the atmosphere through a circular nozzle of 2 mm diameter, under the above indicated temperature and pressure conditions at a flow rate of 50 lt/hr, and hit at a distance of 2.5 mm from said nozzle by a steam jet at a speed upon impact of 470 m/sec., ejected from a 4 mm diameter nozzle arranged at a right angle with the solution nozzle.

Thereby a mixture of steam, fibers and organic solvent was obtained, which through a duct was conveyed to a filter in which the moist fibers were separated from the mixture.

The content in organic solvent of the fibers was less than 0.3% by weight.

At the visual analysis under the VISOPAN microscope, the product proved to consist for about 50% of single fibers having a length comprised between 1 and 10 mm and a diameter of between 5 and 50$\mu$, and for about 50% of single flat fibers rolled up on themselves and having a length of 1–10 mm, a width of 100–500$\mu$ and a thickness of 5–50$\mu$. From specific surface measurements, obtained with a PERKIN ELMER Sorptometer by absorption of $N_2$, the product as a whole proved to have a surface area below 1 sq.mt/g.

150 g of the fibers obtained were admixed to 350 g of RAUMA type cellulose in 25 lt of water. This mixture was thereupon refined in a Lorentzen-Wettres hollander and through the time there were repeatedly drawn samples of pulp with which, after suitable dilutions, were produced sheets by following the procedures commonly used, and using a laboratory sheet forming machine. The characteristics of the sheets thus obtained have been recorded on Table 1.

EXAMPLE NO. 2

Into the autoclave described in example 1 were loaded 30 lt of technical hexane and 3 kg of polyethylene of the type indicated in example 1. By introducing steam into the heating jacket, in the autoclave there was obtained a solution under the following operational conditions:

pressure=2.4 kg/sq.cm
temperature=104° C.

By means of the nozzle device described in example 1, the solution was then ejected from the autoclave (with a flow rate of 45 lt/hr) into atmospheric ambient and hit at a distance of 2.5 mm from the exit nozzle by a steam jet at a speed upon impact of 470 m/sec.

The product gathered on the filter proved to consist for about 50% of single fibers having a length of 1–20 mm and a diameter of 5–50$\mu$ and for about 50% of single flat fibers rolled up on themselves and having a length of 1–20 mm, a width of 100–500$\mu$ and a thickness of 5–50$\mu$, with a superficial area below 1 sq.mt/g.

150 g of this fibrous product were then admixed to 350 g of RAUMA cellulose in 25 lt of water and this mixture was then used for preparing sheets, following the same procedures as have been described in example 1.

The characteristics of said sheets are recorded on Table 1.

EXAMPLE NO. 3

In the autoclave described in example 1 there was prepared a solution consisting of 30 lt of technical hexane and 2.5 kg of polyethylene of the same type as that of example 1. After heating the solution in the autoclave, the following conditions were found:
pressure=2.2 kg/sq.cm
temperature=103° C.

By means of the nozzle device described in example 1 the solution was then ejected from the autoclave with a flow rate of 60 lt/hr, and hit at a distance of 2 mm from the exit nozzle with a steam jet at a speed upon impact of 470 m/sec.

The product that was gathered consisted for about 80% of single fibers from 1 to 5 mm long and with a diameter of from 5 to 20μ, and for about 20% of single flat fibers rolled up on themselves and having a length of 1-5 mm, a width of 50-100μ and a thickness of between 5 and 20μ, its surface area being of about 1 sq.mt/g.

A series of mixtures was then prepared, consisting of 120 g of above said product and of 280 g of cellulose of the respective types RAUMA, Birch, Modo and Kraft, in 20 lt of water. These mixtures were used for preparing sheets by following the procedures described in example 1. The characteristics of the sheets obtained have been recorded on Table 2.

EXAMPLE NO. 4

In the same autoclave of example 1 and maintaining the following conditions:
pressure=14.5 kg/sq.cm
temperature=134° C.,
there was prepared a solution consisting of 30 lt of trichlorofluoromethane and of 3 kg of polyethylene obtained with supported Ziegler catalysts, said polyethylene showing the following characteristics: melt index=18.5; [η] in tetralin at 135° C.=0.9; density=0.952; number of methyls per 100 carbon atoms=0.65; melt temperature (by DSC)=130° C.

By means of the same nozzle device described in example 1, said solution was ejected from the autoclave into atmospheric ambient at a flow rate of 90 lt/hr, and hit at a distance of 3 mm from the exit with a steam jet at impact speed of 470 mt/sec. Thereby was obtained a fibrous product consisting for about 80% of single fibers with a length of from 1 to 3 mm and a diameter of from 5 to 15μ, and for about 20% of single flat fibers rolled up on themselves and having a length of between 1 and 3 mm, a width of between 50 and 100μ and a thickness of between 5 and 15μ, while the surface area of this product amounted to 2 sq.mt/g. Starting from a mixture of 150 g of the product obtained with 350 g of RAUMA cellulose in 25 lt of water, and by following the procedures described in example 1, sheets were prepared whose characteristics have been recorded on Table 1.

EXAMPLE NO. 5

In the same autoclave as that described in example 1 and maintaining the following conditions:
pressure=5.1 kg/sq.cm
temperature=137° C.
a solution was prepared consisting of 30 lt of technical hexane and of 3 kg of polyethylene obtained with Ziegler-type supported catalysts, said polyethylene showing the following characteristics: melt index=18; [η] in tetralin at 135° C.=0.9; density=0.962; number of methyls per 100 carbon atoms=0.21, and melt temperature (with DSC) of 131.5° C. By using the nozzle device of the example 1, but with the nozzles arranged as to form an angle of 85° the solution was ejected from the autoclave into atmospheric ambient at a flow rate of 95 lt/hr, and hit at a distance of 3 mm from the exit nozzle by a $CO_2$ jet at room temperature and at a speed upon impact of 220 m/sec. The product thus obtained consisted for about 90% of single fibers with a length comprised between 2 and 4 mm and a diameter of about 5μ, and for about 10% of flat fibers having a length of 2-4 mm, a width of about 50μ and a thickness of about 5μ, while its surface area amounted to 3.5 sq.mt/g.

EXAMPLE NO. 6

In the same autoclave of example 1 and maintaining the following conditions:
pressure=4.8 kg/sq.cm
temperature=135° C.
there was prepared a solution consisting of 30 lt of technical hexane and 3.5 kg of polyethylene obtained with Ziegler-type supported catalysts, said polyethylene having the following characteristics: melt index=49; [η] in tetralin at 135° C.=0.9; density=0.952; number of methyls per 100 carbon atoms=0.28, and melt temperature (by DSC)=131° C. For carrying out the process, the same nozzle device described in example 1 was used, with the exception that the single formed by the two nozzles was 85°. The solution was ejected into the atmospheric ambient and hit at a distance of 2,5 mm from the ejcting nozzle by a steam jet. The formation conditions for the fibers are the following:
flow rate of the ejected solution=55 lt/hr
impact speed of steam=320 m/sec.

The thus obtained fibrous product consisted for about 70% of single fibers with a length of 2-5 mm and a diameter of from 1 to 5μ, and for about 30% of single flat fibers having a length of 2-5 mm, a width of 50-100μ and a thickness of 1-5μ, while its surface area mounted to about 3 sq.mt/g.

Starting from a mixture of 150 g of the obtained product with 350 g of cellulose (60% Birch, 20% Modo and 20% Kraft), and by following the procedures of example 1, sheets were prepared having the characteristics reported by Table 3.

EXAMPLE NO. 7

In the autoclave of example 1 and maintaining the following conditions:
pressure=5.9 kg/sq.cm
temperature=160° C.
a solution was prepared consisting of 30 lt of technical hexane and of 4.8 kg of polyethylene of example 6. For carrying out the process the same nozzle device as that described in example 1 was used, but with the nozzles arranged to form an angle of 80°. The solution was ejected into the atmospheric ambient and hit at a distance of 3.5 mm from the nozzle by a steam jet.

The operational conditions for producing the fibers were:
flow rate of the ejected solution=125 lt/hr
impact speed of steam jet=320 m/sec.
The product thus obtained consisted for about 80% of fibers with a length of 2-5 mm and a diameter of 1-5μ, and for about 20% of flat fibers having a length 2-5 mm, a width of 50 to 100μ and a thickness of 1-5μ, while its surface area amounted to 5 sq.mt/g.

Starting from a mixture of 150 g of the product obtained with 350 g of cellulose (60% Birch, 20% Modo and 20% Kraft), and by following the procedures described in example 1, sheets were prepared whose characteristics have been recorded on Table 3.

EXAMPLE NO. 8

In the autoclave of example 1 and maintaining it there in at the following conditions:
pressure=5.9 kg/sq.cm
temperature=155° C.
a solution was prepared which conisted of 30 lt of technical hexane and of 1.8 kg of polyethylene of the type of example 6. By using the nozzle device described in example 1, but with the nozzle arranged as to form an angle of 50°, the solution was ejected into the atmospheric ambient and hit at a distance of 3.5 mm from the ejecting nozzle by an oxygen jet at room temperature, under the following conditions:
flow rate of solution: 120 lt/hr
impact speed of oxygen jet: 470 m/sec.
The product consisted almost entirely of single fibers having a length of about 4–5 mm and a diameter of about 5μ; the surface area mounted to 11 sq.mt/g. The content in organic solvent of the fibers was less than 0.3% by weight.

EXAMPLE NO. 9

In the autoclave of example 1 and maintaining therein the following conditions:
pressure: 5.5 kg/sq.cm
temperature: 145° C.
there was prepared a solution consisting of 35 lt of technical hexane and 3 kg of polyethylene obtained by means of supported Ziegler-catalysts, said polyethylene having the following characteristics: melt index=13.6; [η] in teralin at 135° C.=1; density=0.953; number of methyl groups per 100 carbon atoms=0.6 and melt temperature (by DSC)=130° C.

By using the nozzle device of example 1,(nozzles arranged at right angle) the solution was ejected into the atmospheric ambient and hit at a distance of 3 mm from the ejection nozzle by an oxygen jet at room temperature under the following conditions:
flow rate of the ejected solution=100 lt/hr
impact speed of oxygen jet=470 m/sec.

The product proved to consist for about 80% of fibers 1 to 3 millimeter long and with a diameter of 5–20μ, and for about 20% of flat fibers 1 to 3 mm long, width comprised between 50 and 100μ and with a thickness of 50–20μ. The superficial area of the product amounted to 4 sq.mt/g. Starting from a mixture of 150 g of the product obtained with 350 g of RAUMA cellulose, and by following the procedures described in example 1, sheets were prepared whose characteristics have been recorded on Table 4.

EXAMPLE NO. 10

In the autoclave of example 1 and by maintaining in it the following conditions:
pressure=5.4 kg/sq.cm
temperature=142° C.
there was prepared a solution consisting of 30 lt of technical hexane, 2.4 kg of polyethylene of example 9 and of 0.6 kg of an ethylene-ethyl acrylate copolymer (Zetakin 80 of DOW CHEM.). By using the nozzle device of example 1 (nozzles at right angle), the solution was ejected into the atmospheric ambient and hit at a distance of 3 mm from the exit nozzle by a steam jet under the following conditions:
flow rate of the ejected solution=100 lt/hr
impact speed of steam jet=470 m/sec.
The product proved to consist for about 80% of fibers 1–3 mm long and 5–20μ in a diameter, and for about 20% of flat fibers 1–3 mm long, 50–100μ wide and having a thickness of from 5 to 20μ; the surface area of said product amounted to 4 sq.mt/g and the density of the fibers amounted to 0.9450. Starting from a mixture of 150 g of the product obtained with 350 g of RAUMA cellulose, and by following the same procedures as those described in example 1, sheets were prepared whose characteristics have been recorded on Table 4.

EXAMPLE NO. 11

In the same autoclave of example 1 and maintaining in it the following conditions:
pressure: 5.4 kg/sq.cm
temperature: 139° C.
a solution was prepared that consisted of 35 lt of technical hexane, 2.55 kg of the polyethylene of example 9 and of 0.45 kg of polyvinyl chloride (K value=45). By using the nozzles of example 1 arranged at right angle, the solution was ejected into the atmospheric ambient and here hit, at a distance of 4 mm from the ejecting nozzle, by a steam jet. The conditions used in the forming of the fibers were the following:
flow rate of the ejected solution: 110 lt/hr
impact speed of steam jet: 470 m/sec.

The product proved to be constituted for about 85% of fibers 1–3 mm long and of 5–15μ in diameter, and for about 15% of flat fibers 1–3 mm long, 50–100μ wide and with a thickness of from 5 to 15μ; its surface area amounted to 5.5 sq.mt/g. The density of the fibers was 0.9905. The content in organic solvent of the fibers was less than 0.3% by weight.

Starting from a mixture of 150 g of the product obtained with 350 g of RAUMA cellulose, and by following the procedures indicated in example 1, sheets were prepared whose characteristics have been recorded on Table 4. The preparation of the sheets was facilitated by the greater density of the fibrils.

EXAMPLE NO. 12

In the autoclave described in example 1 and by maintaining in it the following conditions:
pressure: 3.4 kg/sq.cm
temperature: 124° C.
a solution was prepared which consisted of 35 lt of technical hexane and 3 kg of the polyethylene of example 9, to which was added 3% by weight of $TiO_2$ on the polyethylene. By using the nozzle device of example 1 but with the nozzles arranged to form an angle of 50°, the solution was ejected into the atmospheric ambient and hit, at a distance of 5 mm from the ejecting nozzle, by a nitrogen jet at room temperature under the following conditions:
flow rate of the ejected solution: 95 lt/hr
impact speed of nitrogen jet: 470 m/sec.

The product proved to consist for about 80% of fibers 2–4 mm long and 1–5μ in diameter, and for 20% of flat fibers 2–4 mm long, 50–100μ wide and 1–5μ in diameter. The superficial area of the product amounted to 3.5 sq.mt/g, while the density of the fibers was 0.98.

Starting from a mixture of 150 g of the product obtained with 350 g of RAUMA cellulose, and by following the procedures described in example 1, sheets were prepared whose characteristics have been recorded on Table 4.

EXAMPLE NO. 13

In the autoclave described in example 1 and by maintaining in it the following conditions:
pressure: 5.5 kg/sq.cm
temperature: 163° C.
a solution was prepared that consisted of 30 lt of technical hexane, 2.1 kg of a polypropylene of a high isotactic index obtained by means of Ziegler-type catalysts, and which showed the following characteristics:
melt index: 6.7
density: 0.9085
melt temperature (DSC): 165° C.
By using the nozzles of example 1, but arranged as to form an angle of 70°, the solution was ejected into the atmospheric ambient and hit at a distance of 7 mm from the ejecting nozzle by a steam jet under the following conditions:
flow rate of the ejected solution: 40 lt/hr
impact speed of steam jet: 470 m/sec.
The product proved to consist almost completely of fibers 1–5 mm long and 5–20μ in diameter. The surface area of the product amounted to 7 sq.mt/g.

Starting from a mixture of 150 g of the product obtained with 350 g of cellulose (60% Birch, 20% Modo and 20% Kraft), and by following the procedures described in example 1, sheets were prepared whose characteristics have been recorded on Table 5.

EXAMPLE NO. 14

In the autocalve described in example 1, and by maintaining in it the following conditions:
pressure: 4.5 kg/sq.cm
temperature: 155° C.
a solution was prepared consisting of 30 lt of technical hexane and 3 kg of low-density polyethylene, said polyethylene having the following characteristics:
melt index: 4.6
density: 0.9235
melting temperature (DSC): 118° C.
By using the nozzle device of example 1, but with the nozzles arranged to form an angle of 60°, the solution was ejected into the atmospheric ambient and hit at a distance of 7 mm from the ejecting nozzle, by a nitrogen jet at room temperature, under the following conditions:
flow rate of the ejected solution: 30 lt/hr
impact speed of nitrogen jet: 470 m/sec.

The product thus obtained consisted essentially of fibers 1–3 mm long and 5–15μ in diameter. The surface area amounted to 13 sq.mt/g. The content in organic solvent of the fibers was less than 0.3% by weight.

Starting from a mixture of 150 g of the product obtained with 350 g of cellulose (60% Birch, 20% Modo and 20% Kraft), and by following the procedures described in example 1, sheets were prepared whose characteristics have been recorded on Table 5.

EXAMPLE NO. 15

In the same autoclave of example 1 and by maintaining in it the following conditions:
pressure=3.0 kg/sq.cm
temperature=140° C.
a solution was prepared which consisted of 30 lt of technical hexane, and 2.1 kg of a polyethylene obtained with Ziegler-type unsupported catalysts, and which had the following characteristics:
melt index=0.47;
density=0.9603;
number of methyl groups per 100 carbon atoms <0.1, and melting temperature=134° C.
By using the nozzles of example 1, arranged as to form an angle of 70°, the solution was ejected into the atmospheric ambient and hit, at a distance of 5 mm from the nozzle, by a $CO_2$ jet at room temperature, under the following conditions:
flow rate of the ejected solution=95 lt/hr
impact speed of carbon dioxide jet=320 m/sec.

The product obtained consisted for about 70% of fibers 1–10 mm long and 5–20μ in diameter, and for about 30% of flat fibers 1–10 mm long, 50–100μ wide and 5–20μ thick. The surface area mounted to about 2 sq.mt/g.

Starting from a mixture of 150 g of the product obtained with 350 g of cellulose (60% Birch, 20% Modo and 20% Kraft), and by following the procedures described in example 1, sheets were prepared whose characteristics have been recorded on Table 5.

EXAMPLE NO. 16

In the autoclave described in example 1 was prepared a solution consisting of 30 lt of technical hexane and 3 kg of the polyethylene of example 5.

After heating up the solution in the autoclave, the following conditions were found:
pressure: 5.6 kg/sq.cm
temperature: 132° C.
By using the nozzle device of example 1 (nozzles at right angle) the solution was ejected into the atmosphere and hhit, at a distance of 5 mm from the ejecting nozzle, by a steam jet under the following conditions:
flow rate of solution=90 lt/hr
impact speed of steam jet=470 m/sec.

The product obtained consisted for about 90% of single fibers from 1 to 3 mm long and with a diameter of between 5 and 15μ and for about 10% of flat fibers rolled up on themselves and having a length of 1–3 mm, a width of about 50μ and a thickness of 5–15μ. Its surface area amounted to 2,5 sq.mt/g.

The preparation was repeated 6 (six) times so as to get 15 kg of product. 12 kg of it were admixed to 27.6 kg of cellulose (60% Birch, 20% Modo and 20% Kraft) and 9.5 kg of kaolin in about 1,200 lt of water. The mixture was then continuously refined in a conical refiner until reaching 36° SR, whereupon it was additioned with 0.08 kg of an optical bleacher (Calcofluor 4 MB), 0.8 kg of glue (Aquapel 360 XZ) and with 1.2 g of co-adjuvant (Kymene 557). To this mixture was then added water to double the volume of the suspension which was then transferred into the feeding vat of a continuous machine of the drum type, having a useful width of about 55 cm. There have thus been prepared 40 kg of paper whose characteristics have been reported on Table 6 (Test B) together with those obtained in a comparative test using only 40 kg of cellulose (60% Birch, 20% Modo and 20% Kraft) (Test A).

Part of the paper obtained from the pulp containing polyethylene fibers had been calendered between two rolls maintained at a temperature of about 140° C. and also the results of this operation have been recorded on the above mentioned table (Test C).

The following examples illustrate the use of surfactants in the polyolefin solution.

EXAMPLE NO. 17

Into a 150 lt autoclave fitted with a heating sleeve and a blade stirrer, were loaded 6 kg of polyethylene having the following characteristics:
melt index=4.1
density=0.9633
$CH_3$/100 C number=0.1
melting temperature (DSC)=133° C.
together with 30 g of a surfactant consisting of an ethoxylated stearylamine and 70 lt of technical hexane. Using a heating with oil, the following conditions were established in the autoclave:
temperature=150° C.
total pressure=7 kg/sq.cm
nitrogen overpressure=1.6 kg/sq.cm By means of a pipe sheathed with a steam-heated sleeve, the solution was conveyed to a nozzle having a diameter of 2 mm, ejected through said nozzle into the outer atmospheric ambient, and hit, at a distance of 2.5 mm from the ejection nozzle, by a nitrogen jet at room temperature, flowing from a second 4 mm diameter nozzle forming with the first nozzle an angle of 50°.

The operational conditions were as follows:
temperature of the solution at the nozzle=158° C.
pressure of the solution at the nozzle=7,2 kg/sq.cm
pressure of the nitrogen at the nozzle=21 kg/sq.cm
flow rate of the solution—100 kg/hour
impact speed of the nitrogen=320 m/sec.

The product that was gathered, examined at a Vispan (Riechert) microscope, appeared to consist for 80% of fibers 2 to 5 mm long, and having a diameter of between 1 and 5μ, and for 30% of flat fibers 2 to 5 mm long, 20 to 50μ wide and from 1 to 5μ thick, and to contain less than 0.3% by weight of solvent.

The superficial area of the product, measured with a Perkin-Elmer Sorptometer, proved to be equal to 2.9 sq.mt/g.

150 g of the fibers thus obtained were admixed with 350 g of cellulose (60% Husum Birch, 20% Husum Kraft and 20% Modo Crown) in 25 lt of water. The mixture dispersed itself immediately.

The aqueous mixture was then refined in a Lorentzen-Wettres hollander and, after suitable dilution, used for producing sheets according to the procedures commonly used, by means of a laboratory sheet-forming machine. The characteristics of the sheets thus obtained have been recorded on Table 7.

EXAMPLE NO. 18

Into the autoclave of example 17 were loaded 6 kg of polyethylene of the same characteristics as that described in example 17, 30 g of a surfactant consisting of nonylphenol ethoxylate (molar ratio nonylphenol/ethylene oxide=1.6), and 70 lt of technical hexane.

Using a heating with oil, in the autoclave were established the following conditions:
temperature=155° C.
total pressure: 8.2 kg/sq.cm
nitrogen overpressure=1.6 kg/sq.cm Using the same procedures and equipment described in example 17, but with the nozzles arranged to form an angle of 60°, the solution was ejected into the outer atmospheric ambient, hitting it, at a distance of 5 mm from the ejection nozzle, with a nitrogen current at room temperature.

The operational conditions were the following:
temperature of solution at the nozzle=175° C.
diameter of solution ejecting nozzle=2 mm
flow rate of solution=108 kg/hr
pressure of solution at the nozzle=9 kg/sq.cm
diameter of nitrogen ejecting nozzle=4 mm
pressure of nitrogen at the nozzle=20 kg/sq.cm
impact speed of the nitrogen=370 mt/sec.

The product that was gathered, proved to consist for 80% of fibers from 1 to 3 mm long and having a diameter of between 1 and 10μ, and for 20% of flat fibers from 1 to 3 mm long, from 20 to 50μ wide and from 1 to 10μ thick.

The superficial area of the product amounted to 2.5 sq.m/g.

150 g of the fibers thus obtained were admixed to 350 g of cellulose (60% Husum Birch, 20% Husum Kraft and 20% Modo Crown) in 25 lt of water. Thereby was obtained the immediate complete dispersion of the fibers in water.

Starting from this aqueous mixture and following the same procedure as described in example 1, sheets were prepared that showed the characteristics recorded on Table 7.

EXAMPLE NO. 19

Into the autoclave of example 17 were loaded 6 kg of polyethylene of the same characteristics of the polyethylene described in example 17, 30 g of a surfactant consisting of nonylphenolethoxylate (1 mole of nonylphenol per 7.5 moles of ethylene oxide), and 70 lt of heptane.

Using a heating with oil, the following conditions were established inside the autoclave:
temperature=165° C.
total pressure=7.0 kg/sq.cm
nitrogen overpressure=2 kg/sq.cm Using the procedures and equipment of example 17, but with the nozzles arranged to form an angle of 85°, the polymeric solution was ejected into the external atmospheric ambient, and hit at a distance of 5 mm from the ejection nozzle with a flow of carbon dioxide at room temperature.

The operational conditions were the following:
temperature of the solution at the nozzle=172° C.
diameter of the solution ejecting nozzle=2 mm
flow rate of the solution=100 kg/hr
pressure of the solution at the nozzle=9.0 kg/sq.cm
diameter of $CO_2$ ejecting nozzle=4 mm
pressure of $CO_2$ at the nozzle=19 kg/sq.cm
impact speed of $CO_2$=300 mt/sec.

The product appeared to consist almost totally of fibers 2 to 5 mm long and having a diameter comprised between 1 and 5μ. The superficial area of the product amounted to 2.5 sq.mt/g.

15 g of the thus obtained fibers were admixed to 350 g of cellulose (60% Husum Birch, 20% Modo Crown and 20% Husum Kraft) in 25 lt of water, thereby obtaining an immediate dispersion of the fibers.

Following the procedures described in example 1, from this paste were prepared sheets whose characteristics have been recorded on Table 7.

EXAMPLE NO. 20

Into the autoclave of example 17 were loaded 6 kg of polyethylene having the same characteristics of that of example 17, 30 g of a surfactant consisting of a mixture of $C_{10}$–$C_{12}$ alcohols ethoxylate with ethylene oxide (molar ratio of ethoxylation=1:2), and 70 lt of technical hexane.

By using a heating with oil, the following conditions were established in the autoclave:
temperature=172° C.
total pressure=12 kg/sq.cm
nitrogen overpressure=3.5 kg/sq.cm Using the same procedures and equipment of the example 17, but with the nozzles arranged to form an angle of 65°, the polyethylene solution thus formed was conveyed to the ejection nozzle and the ejected jet was hit at a distance of about 3 mm from the nozzle by a nitrogen current at room temperature.

The operational conditions were the following:
temperature of the solution at the nozzle=190° C.
diameter of solution ejecting nozzle=2 mm
flow rate of solution=105 kg/hr
pressure of solution at the nozzle=12 kg/sq.cm
diameter of the nitrogen ejecting nozzle=4 mm
pressure of nitrogen at the nozzle=21 kg/sq.cm
impact speed of the nitrogen=320 mt/sec.

The product thus obtained appeared to consist completely of fibers from 1 to 3 mm long and with a diameter of between 1 and 20μ.

The supercial area of the product amounted to 4.5 sq.m/g.

150 g of the fibers thus obtained were kneaded together with 350 g of cellulose (60% Husum Birch, 20% Husum Kraft and 20% Modo Crown) in 25 lt of water, thereby obtaining an instantaneous complete dispersion. Following then the procedures described in example 1, with this paste were prepared sheets whose characteristics have been recorded on Table 7.

EXAMPLE NO. 21

Into the autoclave of the example 17 were loaded 7 kg of a polyethylene having the same charcteristics as that of example 17, 3 kg of a calcined clay with 95% of its particles below 10μ, 35 g of a surfactant consisting of the condensation product of a mole of stearic acid with 5.5 moles of ethylene oxide, and 80 lt of technical hexane. By means of heating, the following conditions were established inside the autoclave:
temperature=148° C.
total pressure=7.7 kg/sq.cm
nitrogen overpressure=2.2 kg/sq.cm Using the same procedures and equipment of example 17, but with the nozzles arranged to form an angle of 55°, the mixture containing polyethylene in solution was ejected into the atmospheric ambient through a nozzle and hit at a distance of about 4 mm therefrom by an oxygen current at room temperature. The operational conditions were the following:
temperature of the solution at the nozzle=151° C.
diameter of the solution ejecting nozzle=2 mm
rate flow of solution=70 kg/hr
pressure of the solution at the nozzle=6 kg/sq.cm
diameter of the oxygen ejecting nozzle=4 mm
pressure of the oxygen at the nozzle=21 kg/sq.cm
impact speed of the oxygen=320 mt/sec.

The product thus obtained consisted for 80% of fibers between 3 and 5 mm long and with a diameter of between 1 and 5 and for 20% of flat fibers from 3 to 5 mm long, 20 to 50μ wide and from 1 to 5μ thick.

The superficial area of the product amounted to 2.5 sq.mt/g, while the density (at 23° C.) was 1.163 g/cu.cm.

150 g of the fibers thus obtained were kneaded together with 350 g of cellulose (60% Husum Birch, 20% Husum Kraft and 20% Modo Crown) in 25 lt of water, thereby obtaining an immediate complete dispersion.

Using this paste, with the procedures of example 1, sheets were prepared whose characteristics have been recorded on Table 7.

EXAMPLE NO. 22

Into the same autoclave of example 17 were loaded 7 kg of a polyethylene of the same characteristics as that used in example 17, 3 kg of the clay described in example 21, 35 g of a surfactant consisting of monolauric ester of sorbitol and 80 lt of technical hexane.

Through heating, in the autoclave were established the following operational conditions:
temperature=147° C.
total pressure=8.7 kg/sq.cm
nitrogen overpressure=3.5 kg/sq.cm Using the same procedures and the equipment of example 17, but with the nozzles arranged to form an angle of 70°, the mixture containing the polyethylene in solution was conveyed to the nozzle and ejected into the atmospheric ambient, where the jet was hit at a distance of about 4 mm from the nozzle by an oxygen flow at room temperature.

The operational conditions were as follows:
temperature of the solution at the nozzle=165° C.
diameter of the solution ejecting nozzle=2 mm
flow rate of the solution=60 kg/hr
pressure of the solution at the nozzle=8.3 kg/sq.cm
diameter of the oxygen ejecting nozzle=4 mm
pressure of the oxygen at the nozzle=20 kg/sq.cm
impact speed of the oxygen=320 mt/sec.

The product thus obtained consisted for 70% of fibers between 1 and 5 mm long and with a diameter between 1 and 20μ and for 30% of flat fibers from 1 to 5 mm long, from 20 to 50μ wide and from 1 to 20μ thick.

The superficial area of the product was 2.5 sq.mt/g; while the density (at 23° C.) amounted to 1.166 g/cu.cm.

A mixture consisting of 150 g of the fibers thus obtained together with 350 g of cellulose (60% Husum Birch, 20% Husum Kraft and 20% Modo Crown) and kneaded in 25 lt of water, thereby obtaining an immediate complete dispersion.

With the paste thus obtained and following the procedures described in example 1, sheets were therewith prepared whose characteristics have been recorded on Table 7.

EXAMPLE NO. 23

Into the same autoclave of example 17 were loaded 7 kg of a polyethylene of the same characteristics as that of example 17, 3 kg of calcined clay of example 21, 35 g of a surfactant consisting of a mixture of $C_{10}$–$C_{12}$ alcohols etoxylate with ethylene oxide (molar ratio of ethoxylation=1:5), and 80 lt of technical hexane. By heating, the following operational conditions were established in the autoclave:
temperature=169° C.
total pressure=10.9 kg/sq.cm
nitrogen overpressure=2.8 kg/sq.cm Through a pipe sheathed with a steam heated sleeve, the mixture was ejected into the atmospheric ambient through a nozzle and the outcoming jet was hit at a distance of about 2.5 mm from the ejection nozzle by a saturated steam jet coming out of a second nozzle arranged at an angle of 85° with respect to the first nozzle. The operational conditions were the following:

temperature of the solution at the nozzle=180° C.
diameter of the solution ejecting nozzle=2 mm
flow rate of the solution=105 kg/hr
pressure of the solution at the nozzle=11.5 kg/sq.cm
diameter of the steam-ejecting nozzle=4 mm
impact speed of the steam=450 m/sec.

The thus obtained product consisted for 90% of fibers from 2 to 5 mm long and with a diameter of from 1 to 5μ, and for 10% of flat fibers from 2 to 5 mm long, from 20 to 50μ wide and from 1 to 5μ thick.

The density (at 23° C.) of the product amounted to 1.168 g/cu.cm.

A mixture of 150 g of the fibers thus obtained with 350 g of cellulose (60% Husum Birch, 20% Husum Kraft and 20% Modo Crown) was kneaded with 25 lt of water, thereby achieving an immediate complete homogeneous dispersion. Using this paste and operating according to the procedures of example 1, sheets were prepared whose characteristics have been recorded on Table 7.

EXAMPLE NO. 24

Into a 50 lt autoclave provided with a heating sleeve and a stirrer, there were loaded 1.4 kg of a polyethylene prepared with unsupported Ziegler-catalysts and which showed the following characteristics:
melt index=18
density=0.9630
$CH_3$/100 C number=0.26
melt temperature (DSC)=133° C.,
together with 0.6 kg of a ground calcium carbonate, with 90% of the particles sized below 10μ, 40 g of a surfactant consisting of alkylphenol ethoxylate with 4 moles of ethylene oxide, and 14 lt of technical hexane.

The mixture was then heated in the autoclave by sending steam through the sleeve until attaining the following conditions:
temperature=150° C.
pressure=5.4 kg/sq.cm The mixture, containing the polyethylene in solution, was ejected through a nozzle of the 2 mm diameter into the external atmospheric ambient and hit at a distance of about 5 mm from the nozzle by the flow of saturated steam ejected from a nozzle of 4 mm diameter, arranged at an angle with the first nozzle of about 90°. The operational conditions were:
flow rate of solution=15 kg/hr
impact speed of steam=420 m/sec.
The product thus obtained consisted for 70% of fibers from 1 to 3 mm long and with a diameter of from 1 to 15μ, and for 30% of flat fibers from 1 to 3 mm long, from 50 to 100μ wide and from 1 to 15μ thick, while it contained less than 0.3% by weight of solvent.

The density of the product (at 23° C.) amounted to 1.162 g/cu.cm.

A mixture consisting of 150 g of the fibers thus obtained and of 350 g of cellulose (60% Husum Birch, 20% Husum Kraft and 20% Modo Crown) was kneaded with 25 lt of water. Thereby was obtained instantaneous dispersion in the water of the fibrous mixture. With the thus obtained paste, and operating according to the procedures described in example 1, sheets were prepared whose characteristics have been recorded on Table 7.

EXAMPLE NO. 25

In this example is illustrated the preparation of fibers starting from a polyethylene solution free of surfactants and a comparison is made between the dispersability in water of the fibers thus obtained and that of the fibers prepared in the presence of a surfactant, according to the preceding examples.

In the same autoclave of example 24 were loaded 2 kg of the polyethylene described in said example, 0.260 kg of talc and 20 lt of technical hexane.

Through heating the following conditions were established in the autoclave:
temperature=152° C.
pressure=5.2 kg/sq.cm The mixture containing the polyethylene in solution was ejected into the outer atmospheric ambient through a nozzle of a diameter of 2 mm, and was hit at a distance of 1.5 mm therefrom with a jet of carbon dioxide ejected by a nozzle of 4 mm diameter, forming an angle of 90° with the ejected solution. The other operational conditions were:
flow rate of the solution=15 kg/hr
impact speed of the $CO_2$=450 mt/sec.

The product thus obtained consisted for 70% of fibers from 1 to 2 mm long and of a diameter comprised between 1 and 20μ, and for 30% of flat fibers from 1 to 2 mm long, from 50 to 100μ wide and from 1 to 20μ thick. The density of the product (at 23° C.) amounted to 1.050 g/cu.cm.

150 g of the fibers thus obtained and 350 g of cellulose (60% Husum Birch, 20% Husum Kraft and 20% Modo Crown) were mixed together in 25 lt of water. In order to obtain a good dispersion are required about 5 minutes. The paste was then processed according to the procedures described in example 1 and the properties and characteristics of the paper were recorded on Table 7.

EXAMPLE NO. 26

Into the same autoclave of example 17 were loaded 7 kg of a polyethylene having the same characteristics of that of example 17, together with 20 g of a surfactant consisting of an ethoxylated stearylamine, 80 lt of technical hexane and 3 kg of the calcined clay described in example 21. By heating, the following conditions were established in the autoclave:
temperature=169° C.
total pressure=10.9 kg/sq.cm
nitrogen overpressure=2.8 kg/sq.cm
Through a pipe sheathed with a steam heated sleeve, the mixture, containing the dissolved polyethylene, was conveyed to the nozzle and ejected into the outer atmospheric ambient, where it was hit at a distance of 2 mm from the nozzle and at a right angle by a saturated steam jet. The operational conditions were the following:
temperature of the solution at the nozzle=180° C.
diameter of the solution ejecting nozzle=2 mm
flow rate of the solution=150 kg/hr
pressure of the solution at the nozzle=11.5 kg/sq.cm
diameter of steam ejecting nozzle=4 mm
impact speed of the steam=450 mt/sec.

The product thus obtained appeared to consist for 70% of fibers from 1 to 3 mm long and with a diameter of between 1 and 15μ, and for 30% of flat fibers having a length of from 1 to 3 mm, a width of from 20 to 50μ and a thickness of between 1 and 15μ. The density (at 23° C.) of the product amounted to 1.166 g/cu.cm.

A mixture of 150 g of the fibers thus obtained and 350 g of cellulose (60% Husum Birch, 20% Husum Kraft and 20% Modo Crown) was kneaded with 25 lt of water, thereby obtaining an immediate homogeneous dispersion. Using this paste and operating according to the procedures described in example 1, sheets were prepared whose properties and characteristics have been recorded on Table 7.

The following examples illustrate one of the preferred embodiments of the present invention, consisting in using the hitting fluid in form of a mass geometrically co-axial with the ejecting solution nozzle.

EXAMPLE NO. 27

Into a stainless steel 20 lt autoclave, fitted with a heating sleeve and provided with a blade stirrer, 800 g of polyethylene, obtained with Ziegler-type catalysts, non-modified monostadium, and having the following characteristics:
melt index = 1.6
density = 0.9525
$CH_3$/100 C number < 0.1
melt temperature (DSC) = 133° C.,
were introduced besides 6 g of a surfactant consisting of ethoxylated stearylamine and 10 lt of technical hexane.

Using an oil heating, in the autoclave were established the following conditions:
temperature = 185° C.
total pressure = 13.0 kg/sq.cm
nitrogen overpressure = 3.5 kg/sq.cm There was thus obtained a solution of polyethylene in hexane. For the preparation of the fibers starting from said solution, there was used a system of circular co-axial nozzles of the type illustrated by FIG. 3, having the following characteristics:
diameter of the solution ejecting nozzle (3) = 2 mm
diameter of the hitting fluid ejecting nozzle (4) = 4 mm
length of chamber (5) = 10.4 mm
maximum diameter of chamber (5) = 7.5 mm
value of angle $\alpha = 80°$ With reference to FIG. 3, through a thermically insulated duct the polyethylene solution was fed into duct (1), while saturated steam was fed into duct (2). The operational conditions were as follows:
flow rate of the solution = 105 kg/hr
impact speed of steam = 210 mt/sec.

The product that was gathered consisted for 90% of fibers from 4 to 5 mm long and having a diameter comprised between 1 and 5μ, and for 10% of flat fibers from 4 to 5 mm long, from 15 to 20μ wide and from 1 to 5μ thick. The superficial area of the product amounted to about 4 sq.mt/g.

EXAMPLE NO. 28

Into the same autoclave of example 27 were introduced 900 g of the polyethylene described in example 27, and 10 lt of technical hexane. Using an oil heating, in the autoclave were established the following conditions:
temperature = 170° C.
total pressure = 11.9 kg/sq.cm
nitrogen overpressure = 3.5 kg/sq.cm For the preparation of the fibers was used a nozzle device of the type and of the dimensions of that described in example 27, but characterized by an angular value $\alpha = 50°$.

Using a duct sheathed by a sleeve and heated by vapor, duct (1) was fed with the polyethylene solution, while into duct (2) was fed a nitrogen flow. The operational conditions at the nozzle were:
temperature of the solution = 190° C.
flow rate of the solution = 95 kg/hr
impact speed of the nitrogen = 320 mt/sec.

A product was thereby obtained which consisted almost exclusively of fibers from 4 to 5 mm long and from 1 to 3μ thick. The superficial area of the product amounted to 3.5 sq.mt/g.

EXAMPLE NO. 29

Into the same autoclave of example 27 were introduced 720 g of polypropylene with a high index of syndiotacticity, obtained with Ziegler-type catalysts and having the following characteristics:
melt index = 6.5
density = 0.9083
melt temperature (DSC) = 160° C.
besides 6 g of a surfactant obtained from the condensation of 1 mole of stearic acid with 5.5 moles of ethylene oxide, and 10 lt of technical hexane.

By means of heating, in the autoclave were established the following conditions:
temperature = 171° C.
total pressure = 8.8 kg/sq.cm
nitrogen overpressure = 3.0 kg/sq.cm For the preparation of the fibers was used a circular nozzle system of the type and dimensions illustrated in example 27, but characterized in that the angle $\alpha$ was equal to 45°.

Through a sleeved and vapor-heated pipe, duct (1) was fed with the polypropylene solution while into duct (2) was fed an oxygen flow.

The operational conditions at the nozzles were:
temperature of the solution = 190° C.
flow rate of the solution = 90 kg/hr
impact speed of the oxygen flow = 420 m/sec.

Thereby was obtained a product consisting totally of fibers from 4 to 5 mm long, with a diameter of from 1 to 3μ, and with a superficial area of 4 sq.mt/g.

TABLE 1*

| | Degree of besting S.R. | Weight g/sq. mt | Thickness μ | Breaking load in Kg. | Elongation at break in % | Length of break, mt. | Bursting Kg/sq. cm | Tearing in g | Porosity |
|---|---|---|---|---|---|---|---|---|---|
| RAUMA-type | 22 | 61 | 130 | 44 | 2.5 | 4.800 | 1.5 | 54 | 1550 |
| cellulose** | 27 | 64 | 130 | 43 | 2.5 | 4.500 | 1.7 | 55 | 920 |
| | 35.5 | 62 | 120 | 4.7 | 2.5 | 5.000 | 2.0 | 53 | 450 |
| | 41 | 62 | 120 | 5.5 | 2.0 | 5.900 | 2.1 | 50 | 320 |
| Example no 1 | 21.5 | 62 | 150–200 | 1.9 | 2.0 | 2.000 | 0.5 | 57 | 2050 |
| | 27 | 61 | 140–200 | 2.5 | 2.0 | 2.750 | 0.8 | 60 | 850 |
| | 34 | 59 | 100–180 | 2.3 | 2.0 | 2.600 | 0.9 | 60 | 450 |
| | 42 | 57 | 140 | 2.5 | 2.5 | 3.000 | 0.8 | 50 | 300 |
| Example no 2 | 22.5 | 64 | 120–150 | 2.6 | 2.0 | 2.700 | 0.9 | 70 | 1100 |
| | 34 | 63 | 120–140 | 2.6 | 1.5 | 2.750 | 1.0 | 70 | 650 |
| | 42 | 67 | 120–150 | 3.5 | 1.5 | 2.500 | 1.2 | 70 | 250 |
| | 52 | 67 | 120–130 | 3.5 | 1.5 | 2.500 | 1.2 | 64 | 100 |
| Example no 4 | 25.5 | 61 | 130 | 2.1 | 2.0 | 2.300 | 0.7 | 38 | 1000 |
| | 34 | 58 | 120 | 2.5 | 2.0 | 2.900 | 0.8 | 37 | 1150 |

TABLE 1*-continued

| Degree of besting S.R. | Weight g/sq. mt | Thickness μ | Breaking load in Kg. | Elongation at break in % | Length of break, mt. | Bursting Kg/sq. cm | Tearing in g | Porosity |
|---|---|---|---|---|---|---|---|---|
| 45 | 59 | 120 | 3.0 | 2.0 | 2.450 | 0.9 | 33 | 500 |

*The characteristics have been determined according to the ATICELCA rules (Associazione Tecnici Italiani Cellulose e Carta).
**Sulphite conifer cellulose

TABLE 2*

| | RAUMA-TYPE CELLULOSE | | | | 70% RAUMA 30% OF POLY-ETHYLENE FIBRES | | | | MODO-TYPE FIBRES** | | | | 70% MODO, 30% OF POLY-ETHYLENE FIBRES | | | |
|---|---|---|---|---|---|---|---|---|---|---|---|---|---|---|---|---|
| Degree of beating S.R. at 22° C. | 28 | 39 | 44 | 54 | 25 | 36 | 44 | 57 | 24 | 34 | 44 | 56 | 25 | 55 | 45 | 50 |
| Weight, g/sq. mt | 66.6 | 65.7 | 65.8 | 66.4 | 62.20 | 63.92 | 61.20 | 66.40 | 64.4 | 62.2 | 64.5 | 63.8 | 63.96 | 60.92 | 61.18 | 61.64 |
| Breaking load, Kg | 2.5 | 3.2 | 2.8 | 3.6 | 1.52 | 1.90 | 1.63 | 1.98 | 3.0 | 3.8 | 4.3 | 4.7 | 1.97 | 1.66 | 2.06 | 2.56 |
| Elongation at break % | 2.4 | 2.4 | 2.3 | 2.9 | 2.3 | 2.6 | 2.4 | 2.6 | 1.9 | 2.6 | 3.2 | 3.2 | 2.6 | 1.8 | 2.0 | 2.9 |
| Length of breaking mt. | 2500 | 3250 | 2850 | 3600 | 1659 | 2000 | 1800 | 2000 | 3100 | 4000 | 4450 | 4900 | 2050 | 1800 | 2250 | 2750 |
| Tearing resistance, g | 112 | 92 | 104 | 96 | 72 | 80 | 72 | 64 | 104 | 84 | 84 | 64 | 84 | 74 | 72 | 72 |

| | BIRCH CELLULOSE*** | | | | 70% BIRCH, 30% POLY-ETHYLENE FIBRES | | | | KRAFT-TYPE CELLULOSE**** | | | | 70% KRAFT, 30% POLY-ETHYLENE FIBRES | | | |
|---|---|---|---|---|---|---|---|---|---|---|---|---|---|---|---|---|
| Degree of beating S.R. at 22° C. | 25 | 33 | 43 | 58 | 22 | 29 | 36 | 47 | 25 | 35 | 45 | 58 | 28 | 41 | 45 | 57 |
| Weight, g/sq. mt | 72.4 | 65.0 | 67.0 | 65.0 | 65.76 | 63.80 | 66.80 | 60.60 | 67.2 | 67.0 | 65.7 | 64.0 | 64.20 | 65.80 | 67.40 | 66.08 |
| Breaking load, Kg | 2.5 | 3.5 | 4.9 | 4.8 | 1.63 | 2.04 | 2.17 | 2.23 | 5.3 | 7.0 | 6.5 | 7.8 | 2.61 | 2.86 | 3.18 | 3.16 |
| Elongation at break % | 2.2 | 2.5 | 3.2 | 3.4 | 2.3 | 2.4 | 2.9 | 2.7 | 3.1 | 3.7 | 3.2 | 3.8 | 3.4 | 3.2 | 3.3 | 3.0 |
| Length of breaking mt | 2500 | 3550 | 4850 | 4900 | 1650 | 2150 | 2150 | 2500 | 5300 | 6950 | 6650 | 7550 | 2700 | 2900 | 3150 | 3200 |
| Tearing resistance, g | 60 | 80 | 80 | 60 | 52 | 68 | 60 | 56 | 124 | 108 | 152 | 104 | 108 | 100 | 116 | 120 |

*The characteristics have been determined according to ATICELCA rules
**Cellulose manufactured by the Mooch Domejos Co.
***Birch-tree cellulose
****Bleached sulphate cellulose

TABLE 3*

| | Reference cellulose (60% Birch, 20% Modo and 20% Kraft) | | | | Example no 6 | | | | Example no 7 | | |
|---|---|---|---|---|---|---|---|---|---|---|---|
| Degree of beating S.R. at 22° C. | 26 | 38.5 | 47.5 | 56 | 20.5 | 26.5 | 38 | 53 | 25 | 39 | 47.5 |
| Weight, g/sq. mt | 61 | 62 | 80 | 61 | 63 | 62 | 60 | 61 | 60 | 60 | 60 |
| Breaking load kg. | 6.7 | 8 | 8 | 8 | 3.7 | 3.5 | 3.8 | 4.3 | 3.5 | 4 | 4.2 |
| Elongation at break, % | 2.5 | 2.5 | 2.5 | 2.5 | 2.5 | 2.5 | 2.5 | 2.5 | 2.5 | 2.5 | 2.5 |
| Length of break mt | 7320 | 8600 | 8830 | 8750 | 2850 | 3760 | 4220 | 4700 | 3825 | 4370 | 4590 |
| Resistance to tearing, g | 41 | 44 | 40 | 38 | 40 | 39 | 39 | 38 | 40 | 41 | 40 |

*The characteristics have been determined according to ATICELCA rules

TABLE 4*

| | Reference Cellulose (RAUMA) | | | | Example 9 | | | | Example 10 | | | |
|---|---|---|---|---|---|---|---|---|---|---|---|---|
| Degree of beating S.R. at 22° C. | 25.5 | 33 | 41.5 | 52 | 21.5 | 30 | 40.5 | 50 | 24 | 29 | 38 | 46.5 |
| Weight, g/sq. mt | 62 | 67 | 66 | 67 | 61 | 61 | 61 | 61 | 60 | 59 | 61 | 62 |
| Breaking load, kg | 3.8 | 4.5 | 4.4 | 5.0 | 2.1 | 2.3 | 2.6 | 2.8 | 1.9 | 2.4 | 2.7 | 2.8 |
| Elongation at break, % | 2.5 | 2.5 | 2 | 2.5 | 2.5 | 2 | 2 | 2.5 | 2 | 2.5 | 2.5 | 2 |
| Length of break, mt | 4000 | 4480 | 4450 | 4975 | 2500 | 2500 | 2800 | 3050 | 2100 | 2700 | 2950 | 3000 |
| Tearing resistance, g | 62 | 58 | 52 | 55 | 40 | 40 | 40 | 38 | 40 | 40 | 40 | 35 |

| | Example 11 | | | | Example 12 | | | |
|---|---|---|---|---|---|---|---|---|
| Degree of beating S.R. at 22° C. | 22 | 26.5 | 37.5 | 44 | 18 | 26 | 31.5 | 40.5 |
| Weight, g/sq. mt | 61 | 62 | 61 | 58 | 62 | 62 | 60 | 57 |
| Breaking load, kg | 2 | 2.3 | 2.7 | 2.8 | 1.5 | 1.9 | 2.1 | 2.6 |
| Elongation at break, % | 2 | 2 | 2 | 2 | 2 | 2 | 2 | 2 |
| Length of break, mt | 2180 | 2470 | 2550 | 3200 | 1600 | 2050 | 2300 | 3050 |

TABLE 4*-continued

| | | | | | | | | |
|---|---|---|---|---|---|---|---|---|
| Tearing resistance, g | 40 | 40 | 37 | 34 | 40 | 41 | 40 | 32 |

*the characteristics have been determined according to ATICELCA RULES

TABLE 5*

| | Reference cellulose (60% Birch, 20% Modo, 20% Kraft) | | | | Example 13 | Example 14 | Example 15 |
|---|---|---|---|---|---|---|---|
| Degree of refining S.R. at 22° C. | 26 | 38.5 | 47.5 | 56 | 37.6 | 37.7 | 37.2 |
| Weight, g/sq. mt | 61 | 62 | 60 | 61 | 60 | 52 | 60 |
| Breaking load, Kg | 6.7 | 8 | 8 | 8 | 4.1 | 4.1 | 4.7 |
| Elongation at break in % | 2.5 | 2.5 | 2.5 | 2.5 | 2.9 | 2.8 | 2.8 |
| Length of break, mt | 7320 | 8600 | 8830 | 8750 | 4670 | 5400 | 5410 |
| Tearing resistance, g | 41 | 44 | 40 | 38 | 38 | 20 | 50 |

*The characteristics have been determined according to ATICELCA rules.

TABLE 6

| TEST | A | B | C |
|---|---|---|---|
| Weight g/mg | 70.4 | 68.1 | 69.5 |
| Longitudinal breaking load, in kg | 6.6 | 3.51 | 4.8 |
| Transversal breaking load, in kg | 2.04 | 1.35 | 1.8 |
| Length of longitudinal break, mt. | 6300 | 3440 | 4250 |
| Length of transversal break, mt. | 1930 | 1350 | 1800 |
| Average length of break in mt. | 4110 | 2400 | 3020 |
| Elongation at longitudinal break, in % | 3.1 | 3.0 | 3.0 |
| Elongation at transversal break, in % | 5.3 | 3.8 | 3.9 |

TABLE 7*

| | Example no | | | | | | | | | |
|---|---|---|---|---|---|---|---|---|---|---|
| | 17 | 18 | 19 | 20 | 21 | 22 | 23 | 24 | 25 | 26 |
| Degree of beating S.R. at 22° C. | 41 | 45.5 | 40 | 37.5 | 35 | 43 | 33 | 38 | 38.5 | 38 |
| Weight g/sq. mt | 63.8 | 64 | 65.5 | 66.6 | 62.5 | 64.3 | 65.9 | 62.4 | 64.4 | 63.8 |
| Breaking load, kg | 5.35 | 5.09 | 5.61 | 4.20 | 4.72 | 4.62 | 5.33 | 4.08 | 5.56 | 4.70 |
| Elongation at break % | 2.3 | 2.05 | 2.4 | 1.9 | 2.3 | 2.0 | 2.9 | 2.2 | 2.3 | 2.0 |
| Length of rupture, mt | 5258 | 4962 | 5431 | 4026 | 4980 | 4485 | 4871 | 4087 | 5180 | 4595 |

*The characteristics have been determined according to ATICELCA RULES

What we claim is:

1. A process for obtaining short, elongated fibers of a polyolefinic material which are useful as produced and without prior cutting thereof, or disintegrating operations, in the manufacture of paper by conventional paper-making methods, which comprises ejecting a homogeneous, one-phase solution of from 50 to 400 grams of a polyolefinic material per liter of a solvent thereof and which is free of liquids immiscible with the solvent at a temperature at least 60° C. higher than the boiling point of the solvent and under antogenous or higher than autogenous pressure, into a zone of lower pressure in which the solution at least partially expands; and hitting the at least partially expanded solution with a jet of fluid maintained at a temperature lower than the temperature of the solution, the angle at which the jet of fluid hits the at least partially expanded solution of polyolefinic material being between 30° and 90°, the speed at which the solution of polyolefinic material is ejected into the zone of lower pressure being from 1,000 to 200,000 meters per hour, and the impact speed of the hitting fluid being from 200 to 600 meters per second.

2. The process according to claim 1, in which the speed at which the solution of polyolefinic material is ejected into the zone of lower pressure is from 1,500 to 50,000 meters per hour.

3. The process according to claim 1, in which the ratio of the hitting fluid speed to the speed at which the solution of polyolefinic material is ejected into the zone of lower pressure is from about 3.6 to about 2222.

4. The process according to claim 1, in which the ratio of the speed of the hitting fluid to the speed at which the solution of polyolefinic material is ejected into the zone of lower pressure is from about 14.4 to 1450.

5. The process according to claim 1, wherein the polyolefinic material is a polyethylene containing, in minor amounts, units of a monomer different from ethylene and copolymerizable therewith.

6. Process according to claim 1 wherein the polyolefinic material is polyethylene.

7. Process according to claim 1, wherein the polyolefinic material is a copolymer of at least two olefins.

8. Process according to claim 1, wherein the solution includes besides the polyolefinic material, at least one polymer containing polar groups.

9. Process according to claim 1, wherein the high-speed fluid jet consists of steam.

10. Process according to claim 9, wherein the angle comprised between the direction of the fluid and that of ejection of the solution, is comprised between 80° and 85°.

11. Process according to claim 1, wherein the high-speed fluid jet consists of carbon dioxide at room temperature.

12. Process according to claim 11, wherein the angle comprised between the direction of the fluid and that of ejection of the solution, is comprised between 80° and 85°.

13. Process according to claim 1, wherein the high-speed fluid jet consists of nitrogen at room temperature.

14. Process according to claim 13, wherein the angle comprised between the direction of the fluid and that of ejection of the solution, is comprised between 50° and 55°.

15. Process according to claim 1, wherein the high-speed fluid jet consists of oxygen at room temperature.

16. Process according to claim 15, wherein the angle comprised between the direction of the fluid and that of ejection of the solution, is comprised between 40° and 60°.

17. Process according to claim 1, wherein the zone of lower pressure is at atmospheric pressure.

18. Process according to claim 1, wherein the polyolefin solution contains a surfactant.

19. Process according to claim 1, wherein the high-speed fluid is used in the form of a mass which is geometrically co-axial with the nozzle ejecting the polyolefin solution.

20. Process according to claim 1 wherein the solvent is hexane.

21. Process according to claim 1, wherein the solvent is heptane.

22. Process according to claim 1, wherein the solvent is trichlorofluoromethane.

23. Process according to claim 1, wherein the polyolefin solution contains very finely subdivided inorganic materials.

* * * * *